US008519993B2

(12) United States Patent
Yeh et al.

(10) Patent No.: US 8,519,993 B2
(45) Date of Patent: Aug. 27, 2013

(54) DUAL VOLTAGE OUTPUT CIRCUIT

(75) Inventors: Sung-Yau Yeh, Jhubei (TW); Wen-Chi Wu, Jhubei (TW)

(73) Assignee: ILI Technology Corporation, Jhubei City, Hsinchu County (TW)

( * ) Notice: Subject to any disclaimer, the term of this patent is extended or adjusted under 35 U.S.C. 154(b) by 660 days.

(21) Appl. No.: 12/802,070

(22) Filed: May 27, 2010

(65) Prior Publication Data

US 2011/0187190 A1 Aug. 4, 2011

(30) Foreign Application Priority Data

Feb. 1, 2010 (TW) ..... 99102798 A

(51) Int. Cl.
*G09G 5/00* (2006.01)

(52) U.S. Cl.
USPC ..... 345/211; 345/87

(58) Field of Classification Search
USPC ..... 345/211–213, 87, 95, 98, 100; 315/169.1–169.4
See application file for complete search history.

(56) References Cited

U.S. PATENT DOCUMENTS

| | | | | |
|---|---|---|---|---|
| 6,586,990 | B2 * | 7/2003 | Udo et al. | 330/9 |
| 7,053,695 | B2 * | 5/2006 | Ozasa et al. | 327/541 |
| 7,081,792 | B2 * | 7/2006 | Kasai et al. | 330/9 |
| 2005/0212791 | A1 * | 9/2005 | Tsuchi | 345/211 |
| 2008/0088616 | A1 * | 4/2008 | Inokuchi | 345/212 |

* cited by examiner

*Primary Examiner* — Chanh Nguyen
*Assistant Examiner* — Ram Mistry
(74) *Attorney, Agent, or Firm* — Kilpatrick Townsend & Stockton LLP

(57) ABSTRACT

A dual voltage output circuit includes first and second differential driving units. The first differential driving unit is operable to generate a first output voltage from a pair of first input voltages, has first and second nodes to receive first and second voltage levels, respectively, and has a first intermediate voltage node to receive a first intermediate voltage level. The second differential driving unit is operable to generate a second output voltage from a pair of second input voltages, has third and fourth nodes to receive the first and second voltage levels, respectively, and has a second intermediate voltage node to receive a second intermediate voltage level.

8 Claims, 15 Drawing Sheets

DUAL VOLTAGE OUTPUT CIRCUIT

CROSS-REFERENCE TO RELATED APPLICATION

This application claims priority to Taiwanese Application No. 099102798, filed Feb. 1, 2010, the disclosure of which is incorporated herein by reference.

BACKGROUND OF THE INVENTION

1. Field of the Invention

The present invention relates to a voltage output circuit, more particularly to a dual voltage output circuit.

2. Description of the Related Art

Referring to FIGS. 1 to 3, a conventional dual voltage output circuit is used as an output buffer of a pixel circuit controller for application to a Liquid Crystal Display (LCD) 13 and is for generating two pixel-control voltages to control operations of pixel circuits of the LCD 13. The dual voltage output circuit includes first and second differential driving units 11, each of which includes an input stage 111, an intermediate stage 112, and an output stage 113.

The input, intermediate, and output stages 111, 112, 113 of each of the first and second differential driving units 11 are adapted to receive first and second operational voltages VA1, VA2, and cooperate to generate a respective one of first and second output voltages Vy1, Vy2 from a respective one of first and second pairs of input voltages ($Vx1^+$, $Vx1^-$), ($Vx2^+$, $Vx2^-$). It is to be noted that each of the first and second differential driving units 11 operates independently of the other.

The first and second differential driving units 11 are coupled to the LCD 13 via a switching circuit 14. The switching circuit 14 receives the first and second output voltages Vy1, Vy2 from the first and second differential driving units 11, and outputs the first and second output voltages Vy1, Vy2 to the LCD 13 in an alternating manner so as to prevent liquid crystals of the LCD 13 from being damaged by the ion effect.

Furthermore, referring to FIG. 4, the dual voltage output circuit further includes a bias voltage unit 12, which is operable to generate first and second bias voltages VBA, VBB from the first and second operational voltages VA1, VA2, and which is coupled to the intermediate stages 112 of the first and second differential driving units 11 for providing the first and second bias voltages VBA, VBB thereto so as to drive operations thereof.

However, a major drawback of the configuration of the aforesaid dual voltage output circuit is that changes in the first and second pairs of input voltages ($Vx1^+$, $Vx1^-$), ($Vx2^+$, $Vx2^-$) result in changes of the first and second output voltages Vy1, Vy2. Subsequently, upon completion of a successive switching of the first and second output voltages Vy1, Vy2 by the switching circuit 14, more current is drawn from sources of the first and second operational voltages VA1, VA2 due to the difference in numbers of electric charges at the first and second output stages 113.

SUMMARY OF THE INVENTION

Therefore, an object of the present invention is to provide a dual voltage output circuit suitable for use as an output buffer of a pixel circuit controller that is for application to a Liquid Crystal Display (LCD), and that is capable of redistributing electric charges at output stages thereof to reduce power consumption.

Accordingly, a dual voltage output circuit of the present invention includes first and second differential driving units.

The first differential driving unit includes a first input stage, a first intermediate stage, and a first output stage. The first input stage is adapted for receiving a pair of first input voltages, and is operable to generate first and second pairs of first intermediate voltages from the first input voltages.

The first intermediate stage is coupled electrically to the first input stage for receiving the first and second pairs of first intermediate voltages therefrom, and is operable to generate a pair of first control voltages from the first and second pairs of first intermediate voltages. The first intermediate stage has a first node to receive a first voltage level, and a second node to receive a second voltage level.

The first output stage is coupled electrically to the first intermediate stage for receiving the pair of first control voltages therefrom, and is operable to generate a first output voltage from the pair of first control voltages. The first output stage is coupled electrically to the first node of the first intermediate stage, and has a first intermediate voltage node to receive a first intermediate voltage level that is between the first and second voltage levels.

The second differential driving unit includes a second input stage, a second intermediate stage, and a second output stage. The second input stage is adapted for receiving a pair of second input voltages, and is operable to generate first and second pairs of second intermediate voltages from the second input voltages.

The second intermediate stage is coupled electrically to the second input stage for receiving the first and second pairs of second intermediate voltages therefrom, and is operable to generate a pair of second control voltages from the first and second pairs of second intermediate voltages. The second intermediate stage has a third node to receive the first voltage level, and a fourth node to receive the second voltage level.

The second output stage is coupled electrically to the second intermediate stage for receiving the pair of second control voltages therefrom, and is operable to generate a second output voltage from the pair of second control voltages. The second output stage is coupled electrically to the fourth node of the second intermediate stage, and has a second intermediate voltage node to receive a second intermediate voltage level that is between the first and second voltage levels.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
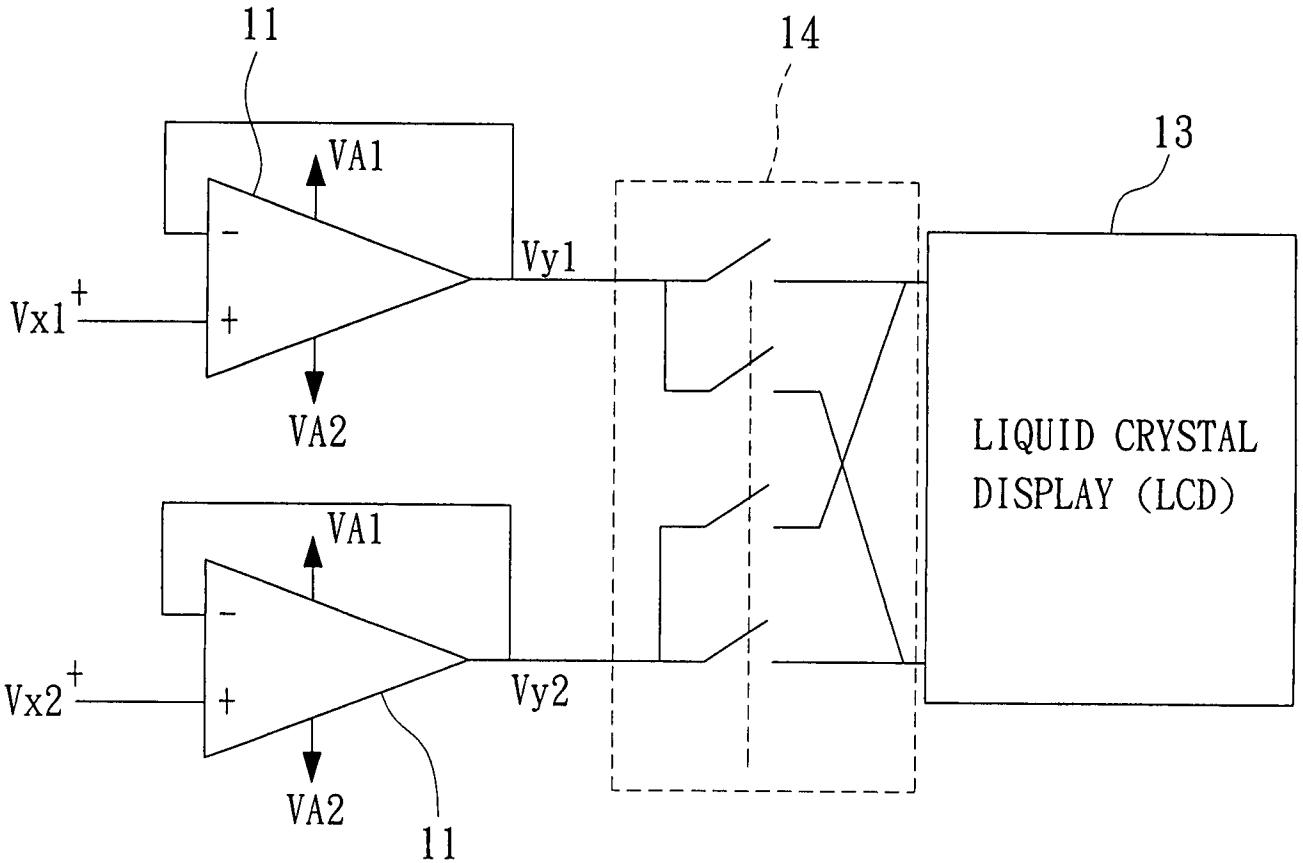
FIG. 1 PRIOR ART
FIG. 1 is a schematic circuit diagram illustrating a conventional dual voltage output circuit applied to a Liquid Crystal Display (LCD)
Figure 2:
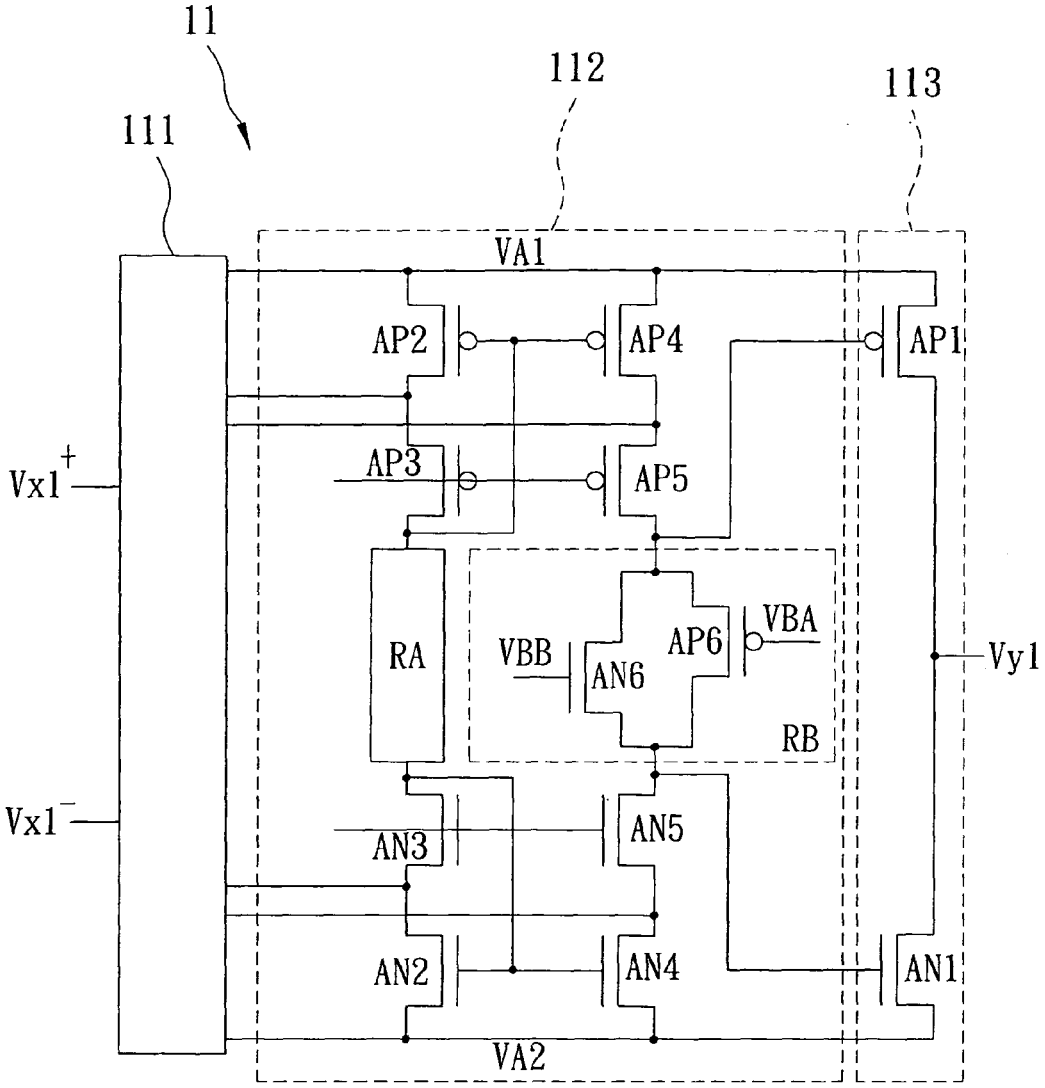
FIG. 2 PRIOR ART
FIG. 2 is a schematic circuit diagram of a first differential driving unit of a conventional dual voltage output circuit.
Figure 3:
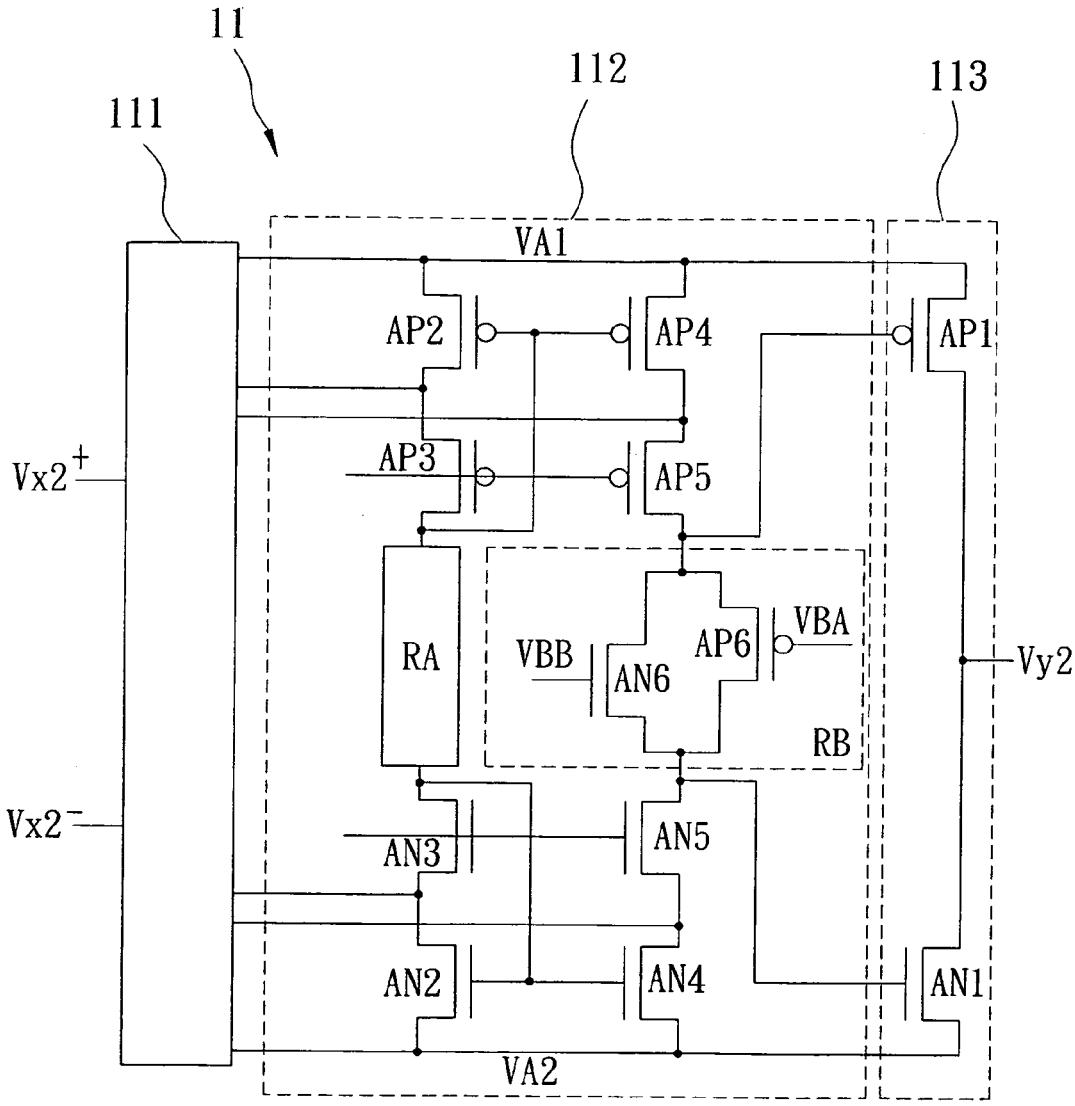
FIG. 3 PRIOR ART
FIG. 3 is a schematic circuit diagram of a second differential driving unit of the conventional dual voltage output circuit.
Figure 4:
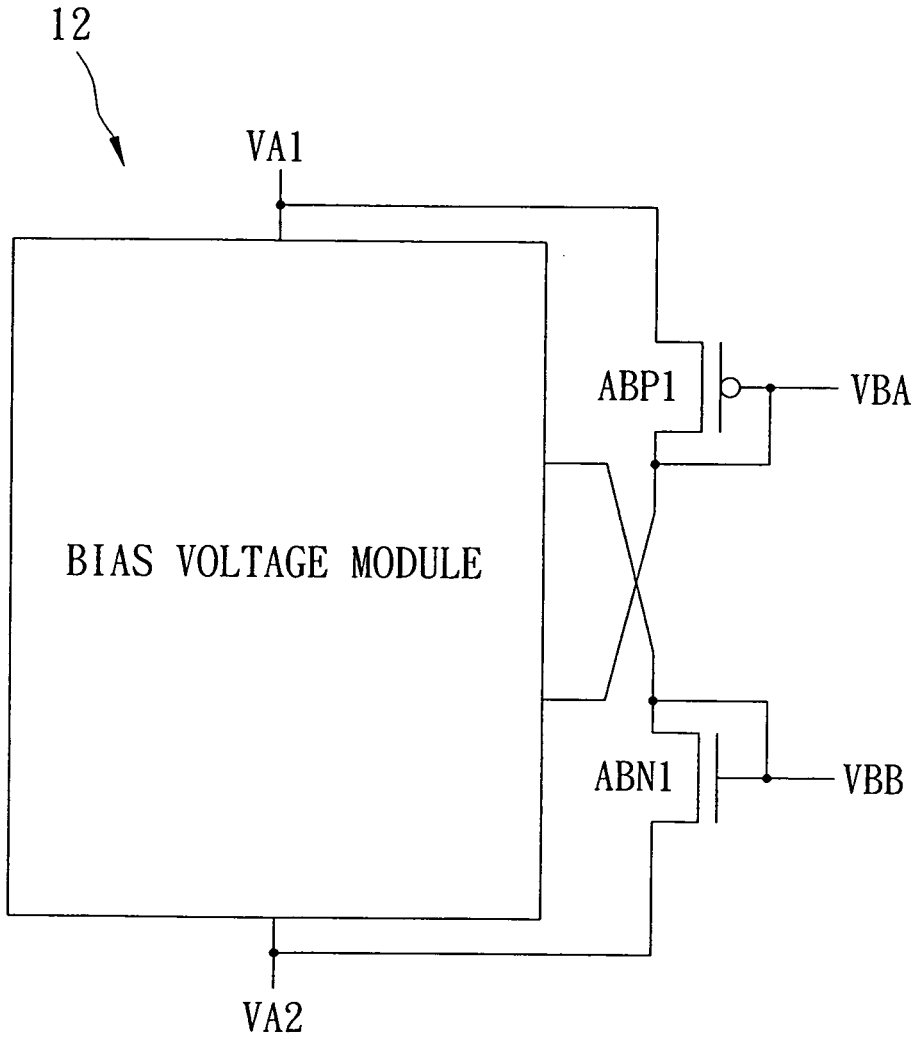
FIG. 4 PRIOR ART
FIG. 4 is a schematic circuit diagram of a bias voltage unit of the conventional dual voltage output circuit.

Before the present invention is described in greater detail, it should be noted that like elements are denoted by the same reference numerals throughout the disclosure.

Throughout the specification, the term "transistor" means one of a metal oxide semiconductor field effect transistor (MOSFET) or a bi-polar junction transistor (BJT), which has a first terminal, a second terminal, and a control terminal.

Figure 5:
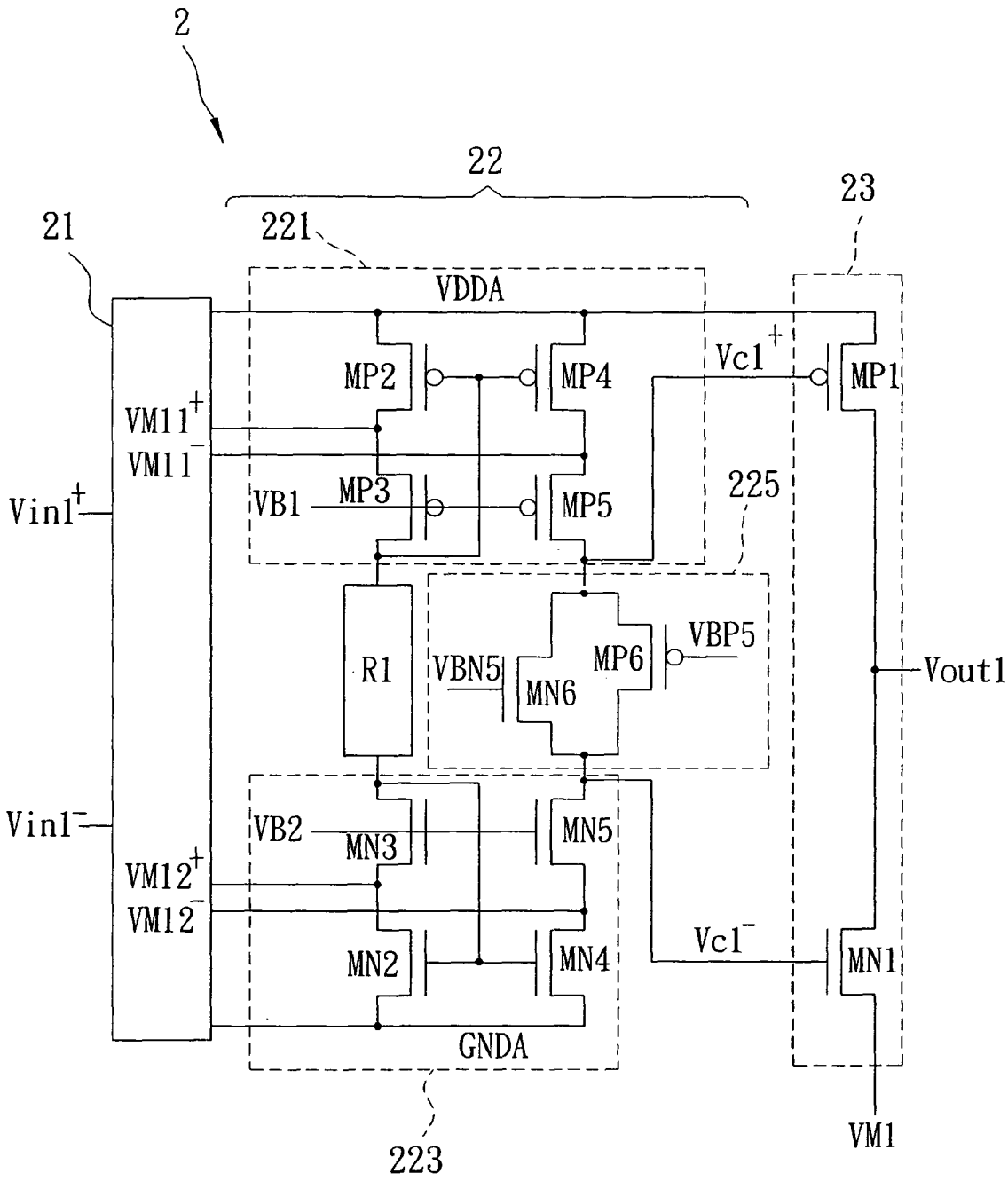
FIG. 5 is a schematic circuit diagram of a first differential driving unit of the first preferred embodiment of a dual voltage output circuit according to the present invention.
Figure 6:
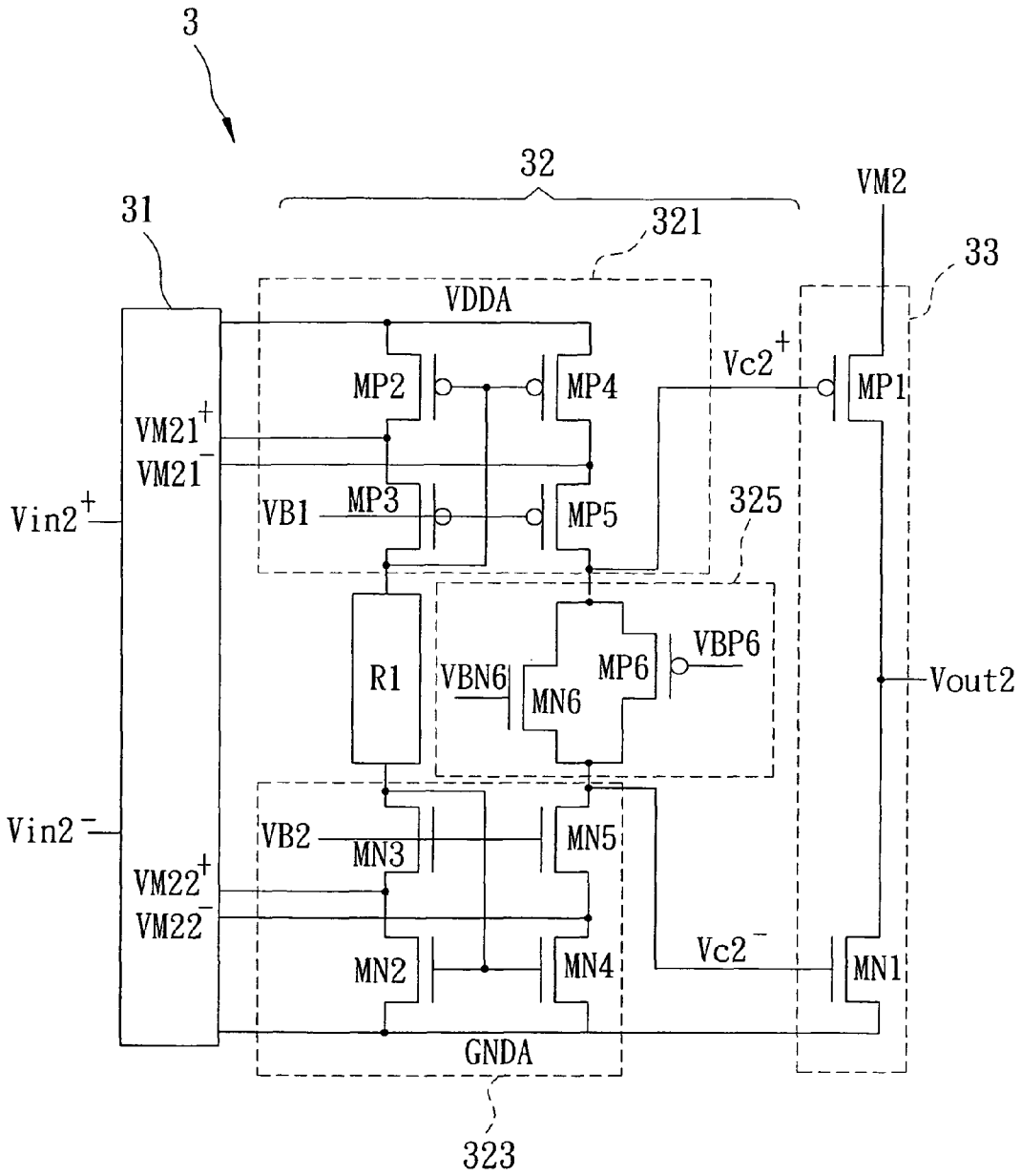
FIG. 6 is a schematic circuit diagram of a second differential driving unit of the first preferred embodiment of the dual voltage output circuit.

Referring to FIGS. 5 and 6, the first preferred embodiment of a dual voltage output circuit according to the present invention includes first and second differential driving units 2, 3. The first differential driving unit 2 includes a first input stage 21, a first intermediate stage 22, and a first output stage 23. The second differential driving unit 3 includes a second input stage 31, a second intermediate stage 33, and a second output stage 33.

Figure 7A:
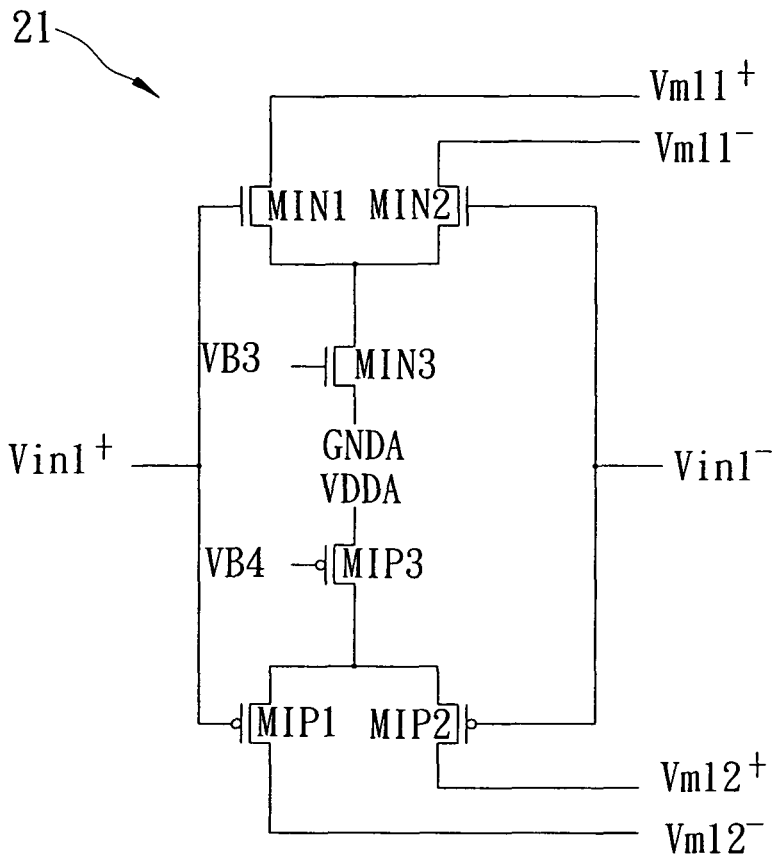
FIG. 7*a* is a schematic circuit diagram illustrating a first input stage of the first differential driving unit of the first preferred embodiment of the dual voltage output circuit.
Figure 7B:
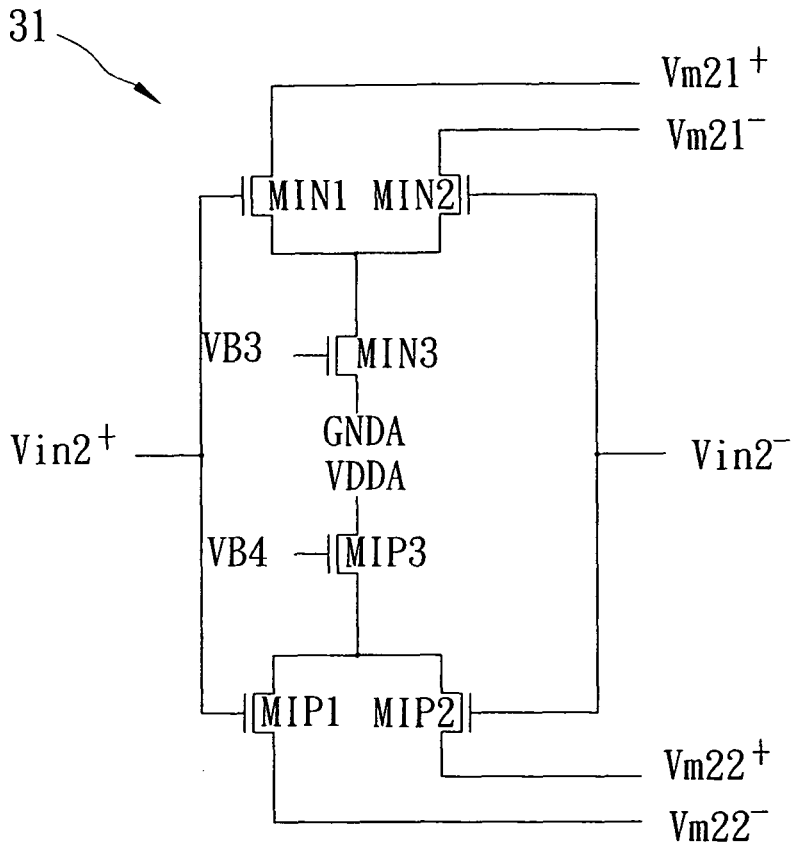
FIG. 7*b* is a schematic circuit diagram illustrating a second input stage of the second differential driving unit of the first preferred embodiment of the dual voltage output circuit.

Referring to FIGS. 7*a* and 7*b*, the first input stage 21 is adapted to receive a pair of first input voltages ($Vin1^+$, $Vin1^-$), and is operable to generate first and second pairs of first intermediate voltages ($Vm11^+$, $Vm11^-$), ($Vm12^+$ $Vm12^-$) from the pair of first input voltages ($Vin1^+$, $Vin1^-$). The second input stage 31 is adapted to receive a pair of second input voltages ($Vin2^+$, $Vin2^-$), and is operable to generate first and second pairs of second intermediate voltages ($Vm21^+$, $Vm21^-$), ($Vm22^+$ $Vm22^-$) from the pair of second input voltages ($Vin2^+$, $Vin2^-$).

The first intermediate stage 22 includes first and second active loads 221, 223, and a floating current module 225. The first active load 221 is coupled electrically to the first input stage 21 for receiving the first pair of first intermediate voltages ($Vm11^+$, $Vm11^-$) therefrom, and has a first node to receive a first voltage level. The first active load 221 includes four transistors (MP2), (MP3), (MP4), (MP5), and receives a bias voltage (VB1) from a bias voltage 8 (see FIG. 8). In the present embodiment, the first voltage level is an operational voltage (VDDA).

The floating current module 225 has first and second load connection nodes that are coupled electrically and respectively to the first and second active loads 221, 223. Each of a pair of first control voltages ($Vc1^+$, $Vc1^-$) is outputted at a corresponding one of the first and second load connection nodes of the floating current module 225.

The second active load 223 is coupled electrically to the first input stage 21 for receiving the second pair of first intermediate voltages ($Vm12^+$, $Vm12^-$) therefrom, and has a second node to receive a second voltage level. The second active load 223 includes four transistors (MN2), (MN3), (MN4), (MN5), and receives a bias voltage (VB2) from the bias voltage unit 8. In the present embodiment, the second node of the second active load 223 is electrically grounded (GNDA). The first active 321 includes four transistors (MP2), (MP3), (MP4), (MP5), and receives the bias voltage (VB1).

The second intermediate stage 32 includes first and second active loads 321, 323, and a floating current module 325. The first active load 321 is coupled electrically to the second input stage 31 for receiving the first pair of second intermediate voltages ($Vm21^+$, $Vm21^-$) therefrom, and has a third node to receive the first voltage level (VDDA). The second active load 323 includes four transistors (MN2), (MN3), (MN4), (MN5), and receives the bias voltage (VB2).

The floating current module 325 has third and fourth load connection nodes that are coupled electrically and respectively to the first and second active loads 321, 323. Each of a pair of second control voltages ($Vc2^+$, $Vc2^-$) is outputted at a corresponding one of the third and fourth load connection nodes of the floating current module 325.

The second active load 323 is coupled electrically to the second input stage 31 for receiving the second pair of second intermediate voltages ($Vm22^+$, $Vm22^-$) therefrom, and has a fourth node to receive the second voltage level voltage (GNDA).

Each of the first and second output stages 23, 33 includes a first n-type transistor (MN1) and a first p-type transistor (MP1).

The control terminal of each of the first p-type transistor (MP1) and the first n-type transistor (MN1) of the first output stage 23 is coupled to the first intermediate stage 22 for receiving a respective one of the pair of first control voltages ($Vc1^+$, $Vc1^-$). The first terminals of the first n-type transistor (MN1) and the first p-type transistor (MP1) of the first output stage 23 are coupled electrically to each other, and a first output voltage (Vout1) is outputted thereat.

The second terminal of the first p-type transistor (MN1) of the first output stage 23 is coupled electrically to the first node of the first active load 221 of the first intermediate stage 22. The second terminal of the first n-type transistor (MP1) of the first output stage 23 is coupled electrically to a first intermediate voltage node to receive a first intermediate voltage level (VM1) that is between the first and second voltage levels (i.e., between the operational voltage (VDDA) and the ground voltage (GNDA)).

The control terminal of each of the first p-type transistor (MP1) and the first n-type transistor (MN1) of the second output stage 33 is coupled to the second intermediate stage 32 for receiving a respective one of the pair of second control voltages ($Vc2^+$, $Vc2^-$). The first terminals of the first n-type transistor (MN1) and the first p-type transistor (MP1) of the second output stage 33 are coupled electrically to each other, and a second output voltage (Vout2) is outputted thereat.

The second terminal of the first n-type transistor (MP1) of the second output stage 33 is coupled electrically to the fourth node of the second active load 323 of the second intermediate stage 32. The second terminal of the first p-type transistor (MN1) of the second output stage 33 is coupled electrically to a second intermediate voltage node to receive a second intermediate voltage level (VM2) that is between the first and second voltage levels (i.e., between the operational voltage (VDDA) and the ground (GNDA)).

In the present embodiment, the floating current module 225 of the first intermediate stage 22 includes a second n-type transistor (MN6) and a second p-type transistor (MP6). The first terminal of the second n-type transistor (MN6) and the second terminal of the second p-type transistor (MP6) of the floating current module 225 are coupled electrically to the first load connection node of the floating current module 225. The second terminal of the second n-type transistor (MN6) and the first terminal of the second p-type transistor (MP6) of the floating current module 225 are coupled electrically to the second load connection node of the floating current module 225. The control terminal of each of the second n-type transistor (MN6) and the second p-type transistor (MP6) of the floating current module 225 is adapted to receive a respective one of first and second bias voltages (VBN5), (VBP5).

Furthermore, the floating current module 325 of the second intermediate stage 32 includes a second n-type transistor (MN6) and a second p-type transistor (MP6). The first terminal of the second n-type transistor (MN6) and the second terminal of the second p-type transistor (MP6) of the floating current module 325 are coupled electrically to the third load connection node of the floating current module 325. The second terminal of the second n-type transistor (MN6) and the first terminal of the second p-type transistor (MP6) of the floating current module 325 are coupled electrically to the fourth load connection node of the floating current module 325. The control terminal of each of the second n-type transistor (MN6) and the second p-type transistor (MP6) of the floating current module 325 is adapted to receive a respective one of third and fourth bias voltages (VBN6), (VBP6).

Figure 8:
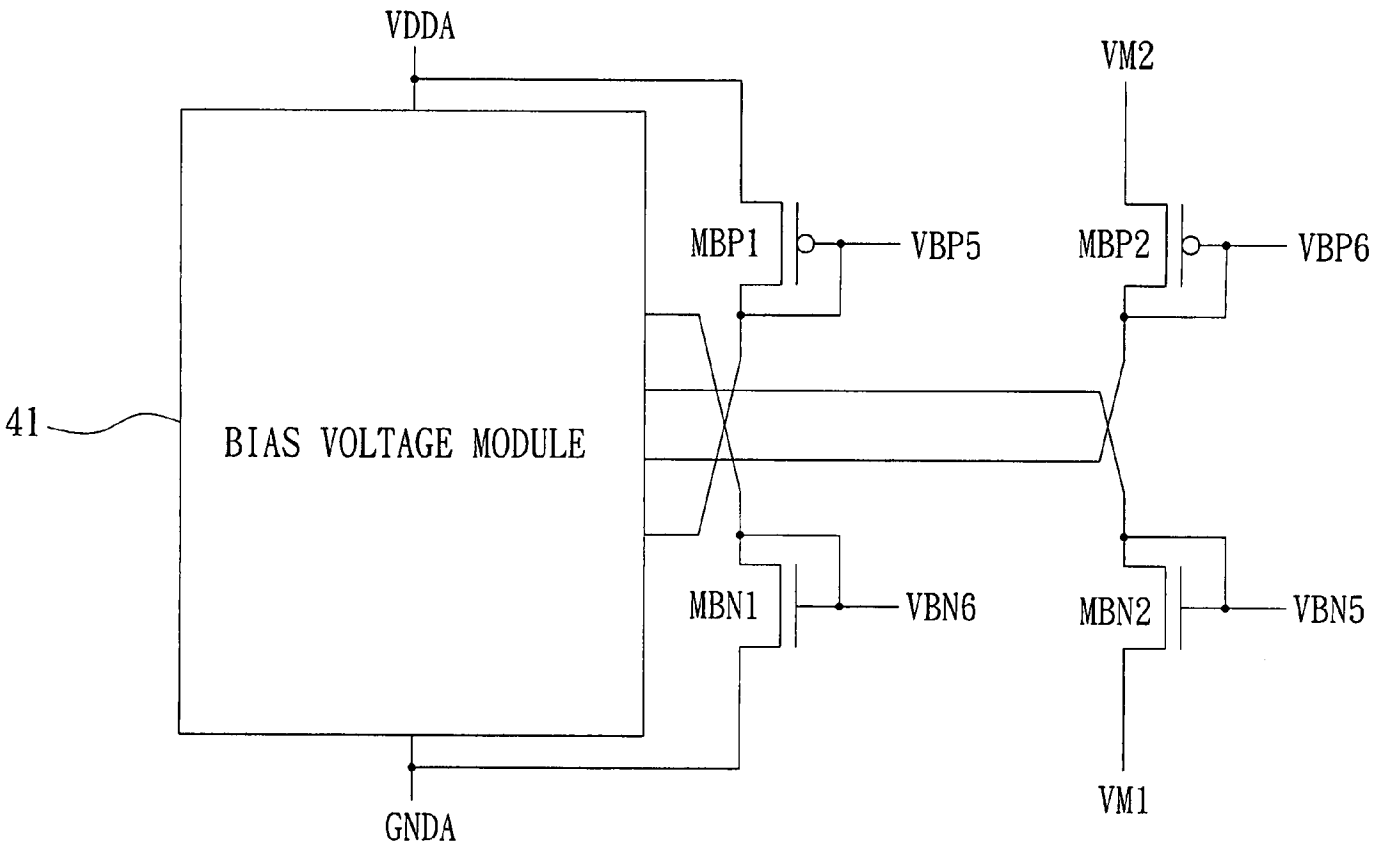
FIG. 8 is a schematic circuit diagram of a bias voltage unit of the first preferred embodiment of the dual voltage output circuit.
Figure 9:
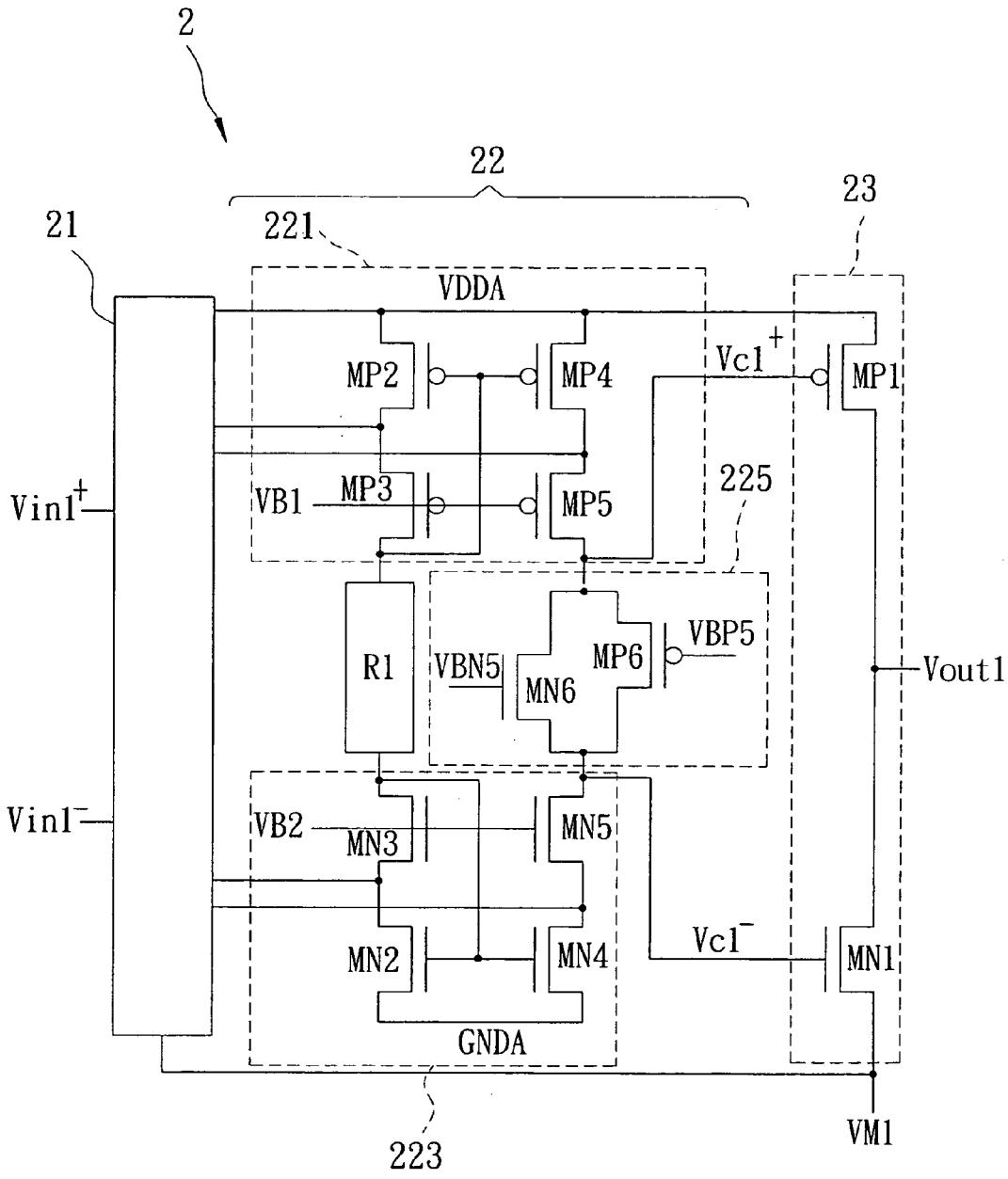
FIG. 9 is a schematic circuit diagram of a first differential driving unit of the second preferred embodiment of the dual voltage output circuit according to the present invention.
Figure 10:
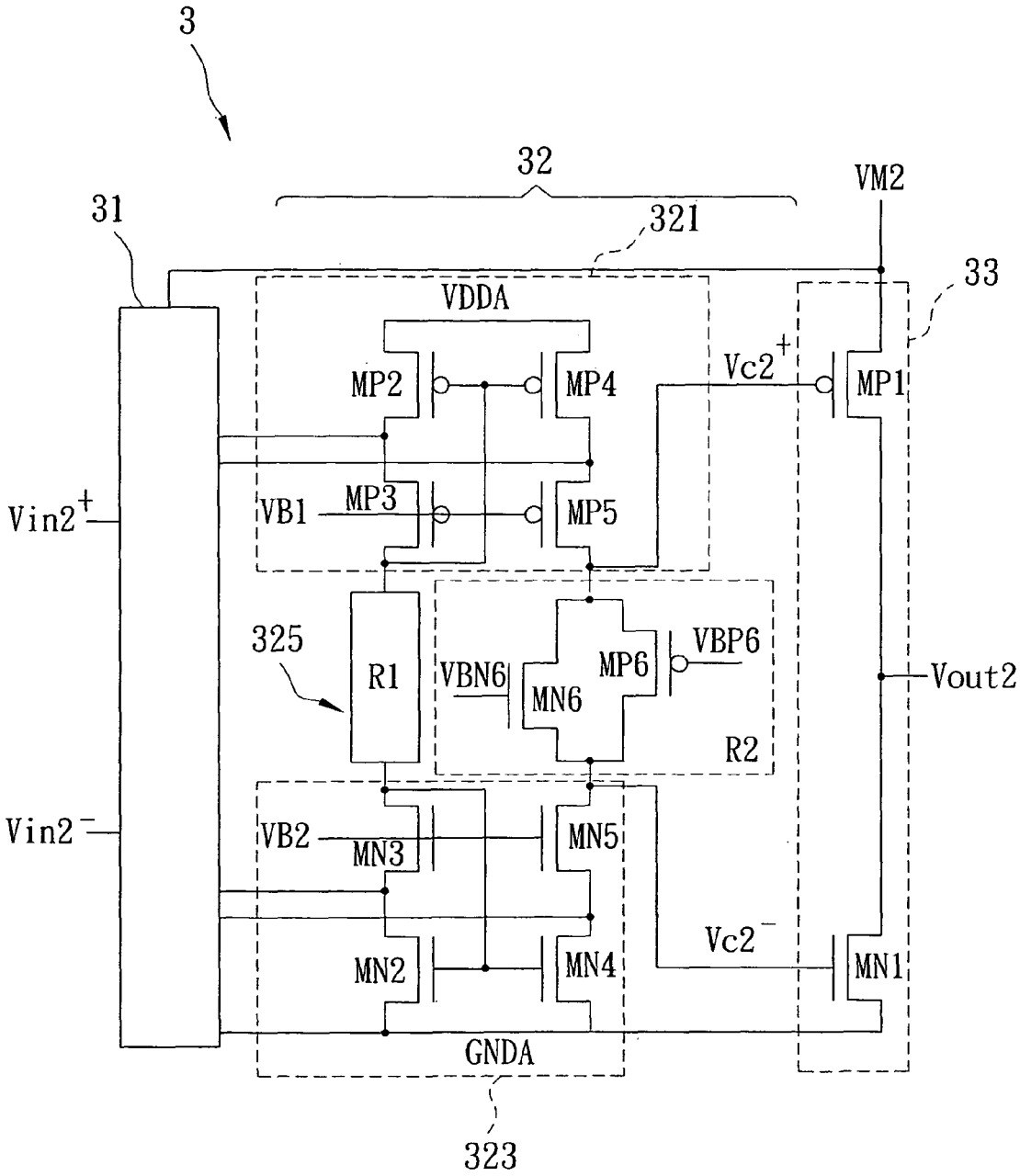
FIG. 10 is a schematic circuit diagram of a second differential driving unit of the second preferred embodiment of the dual voltage output circuit.
Figure 11A:
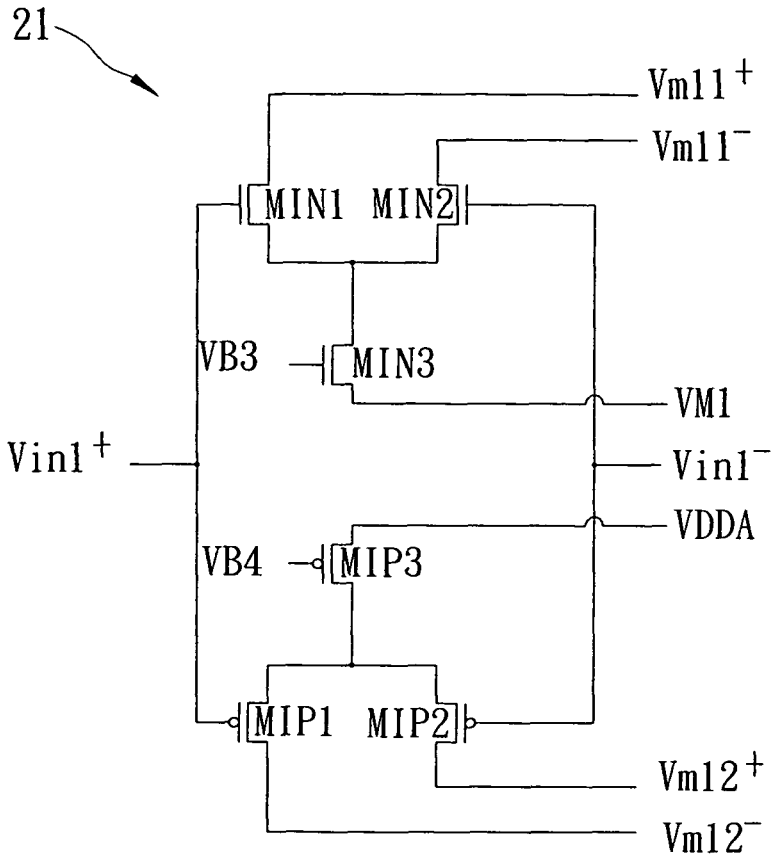
FIG. 11*a* is a schematic circuit diagram illustrating a first input stage of the first differential driving unit of the second preferred embodiment of the dual voltage output circuit.
Figure 11B:
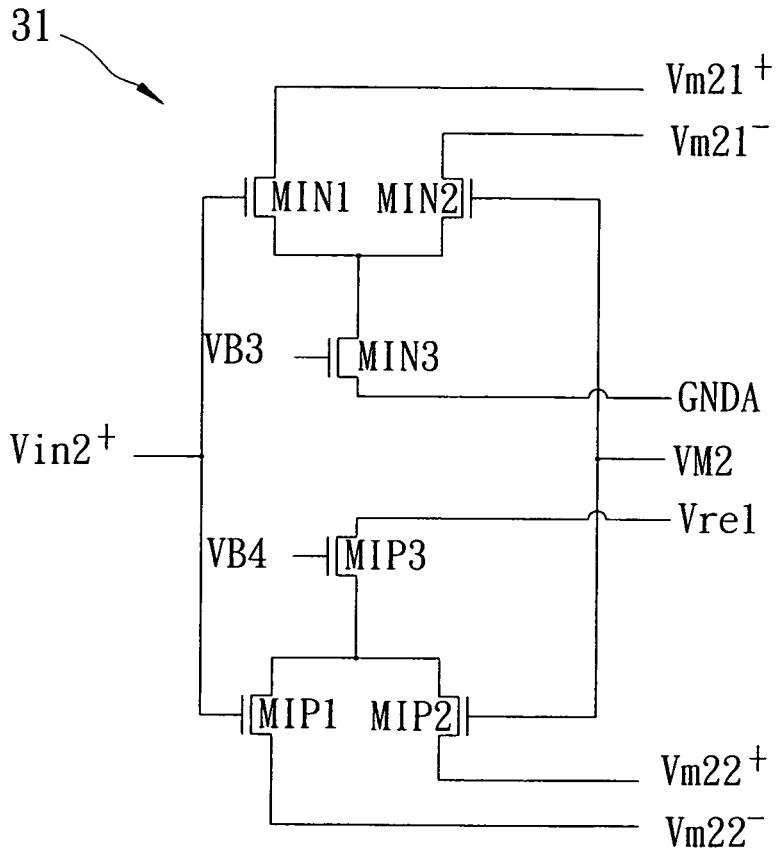
FIG. 11*b* is a schematic circuit diagram illustrating a second input stage of the second differential driving unit of the second preferred embodiment of the dual voltage output circuit.

Referring to FIG. 8, the dual voltage output circuit further includes a bias voltage unit 4 including a bias voltage module 41, first and second n-type bias-voltage transistors (MBN1), (MBN2), and first and second p-type bias-voltage transistors (MBP1), (MBP2). The bias voltage module 41 has fifth and sixth nodes for receiving respectively the first and second voltage levels (i.e., VDDA and GNDA), and is operable to generate the first, second, third, and fourth bias voltages (VBN5), (VBP5), (VBN6), (VBP6), as well as the bias voltages (VB1), (VB2) (see FIGS. 5 and 6).

The second terminal of the second n-type bias-voltage transistor (MBN2) is coupled electrically to the first intermediate voltage node to receive the first intermediate voltage level (VM1). The first terminal and the control terminal of the second n-type bias-voltage transistor (MBN2) are coupled electrically to the bias voltage module 41 for receiving the first bias voltage (VBN5) therefrom, and are further coupled electrically to the floating current module 225 of the first intermediate stage 22 for providing the first bias voltage (VBN5) thereto so as to drive operation of the floating current module 225.

The second terminal of the first p-type bias-voltage transistor (MBP1) is coupled electrically to the fifth node of the bias voltage module 41. The first terminal and the control terminal of the first p-type bias-voltage transistor (MBP1) are coupled electrically to the bias voltage module 41 for receiving the second bias voltage (VBP5) therefrom, and are further coupled electrically to the floating current module 225 of the first intermediate stage 22 for providing the second bias voltage (VBP5) thereto so as to drive operation of the floating current module 225.

The second terminal of the first n-type bias-voltage transistor (MBN1) is coupled electrically to the sixth node of the bias voltage module 41. The first terminal and the control terminal of the second n-type bias-voltage transistor (MBN1) are coupled electrically to the bias voltage module 41 for receiving the third bias voltage (VBN6) therefrom, and are further coupled electrically to the floating current module 325 of the second intermediate stage 32 for providing the third bias voltage (VBN6) thereto so as to drive operation of the floating current module 325.

The second terminal of the second p-type bias-voltage transistor (MBP2) is coupled electrically to the second intermediate voltage node to receive the second intermediate voltage level (VM2). The first terminal and the control terminal of the second p-type bias-voltage transistor (MBP2) are coupled electrically to the bias voltage module 41 for receiving the fourth bias voltage (VBP6) therefrom, and are further coupled electrically to the floating current module 325 of the second intermediate stage 32 for providing the fourth bias voltage (VBP6) thereto so as to drive operation of the floating current module 325.

It is to be noted that the first and second intermediate voltage levels (VM1), (VM2) at the first and second intermediate voltage nodes can be the same or different voltage levels between the first and second voltage levels (VDDA), (GNDA), and can be generated by a voltage-generating circuit (not shown) or two voltage-generating circuits (not shown).

Referring once more to FIGS. 7*a* and 7*b*, the first input stage 21 includes six transistors (MIN1), (MIN2), (MIN3), (MIP1), (MIP2), (MIP3), two of which receive bias voltages (VB3), (VB4) from the bias voltage unit 8. The first input stage 21 is coupled electrically to the first node of the first active load 221 of the first intermediate stage 22 to receive the first voltage level (VDDA), and is further coupled to the second node of the second active load 223 of the first intermediate stage 22 to receive the second voltage level (GNDA). On the other hand, the second input stage 31, which has the same circuit configuration as the first input stage 21, is coupled electrically to the third node of the first active load 321 of the second intermediate stage 32 to receive the first voltage level (VDDA), and is further coupled to the fourth node of the second active load 323 of the second intermediate stage 32 to receive the second voltage level (GNDA).

Referring to FIGS. 9, 10, 11*a*, and 11*b*, in contrast to the above-mentioned configuration of the first and second input stages 21, 31, the first input stage 21 of the second preferred embodiment of a dual voltage output circuit according to the present invention is coupled electrically to the first intermediate voltage node and the first node so as to receive the first intermediate voltage level (VM1) and the first voltage level (VDDA), respectively, and is not coupled to the second node, i.e., the second voltage level (GNDA) is not received thereby. The first input stage 21 of the second preferred embodiment is operable to generate the first and second pairs of first intermediate voltages ($Vm11^+$, $Vm11^-$), ($Vm12^+$, $Vm12^-$) based upon the first voltage level (VDDA) and the first intermediate voltage level (VM1).

Moreover, the second input stage 31 of the dual voltage output circuit of the second preferred embodiment is coupled electrically to the second intermediate voltage node and the fourth node so as to receive the second intermediate voltage level (VM2) and the second voltage level (GNDA), respectively, and is not coupled to the third node, i.e., the first voltage level (VDDA) is not received thereby. The second input stage 31 of the second preferred embodiment is operable to generate the first and second pairs of second intermediate voltages ($Vm21^+$, $Vm21^-$), ($Vm22^+$, $Vm22^-$) based upon the second voltage level (GNDA) and the second intermediate voltage level (VM2).

Figure 12:
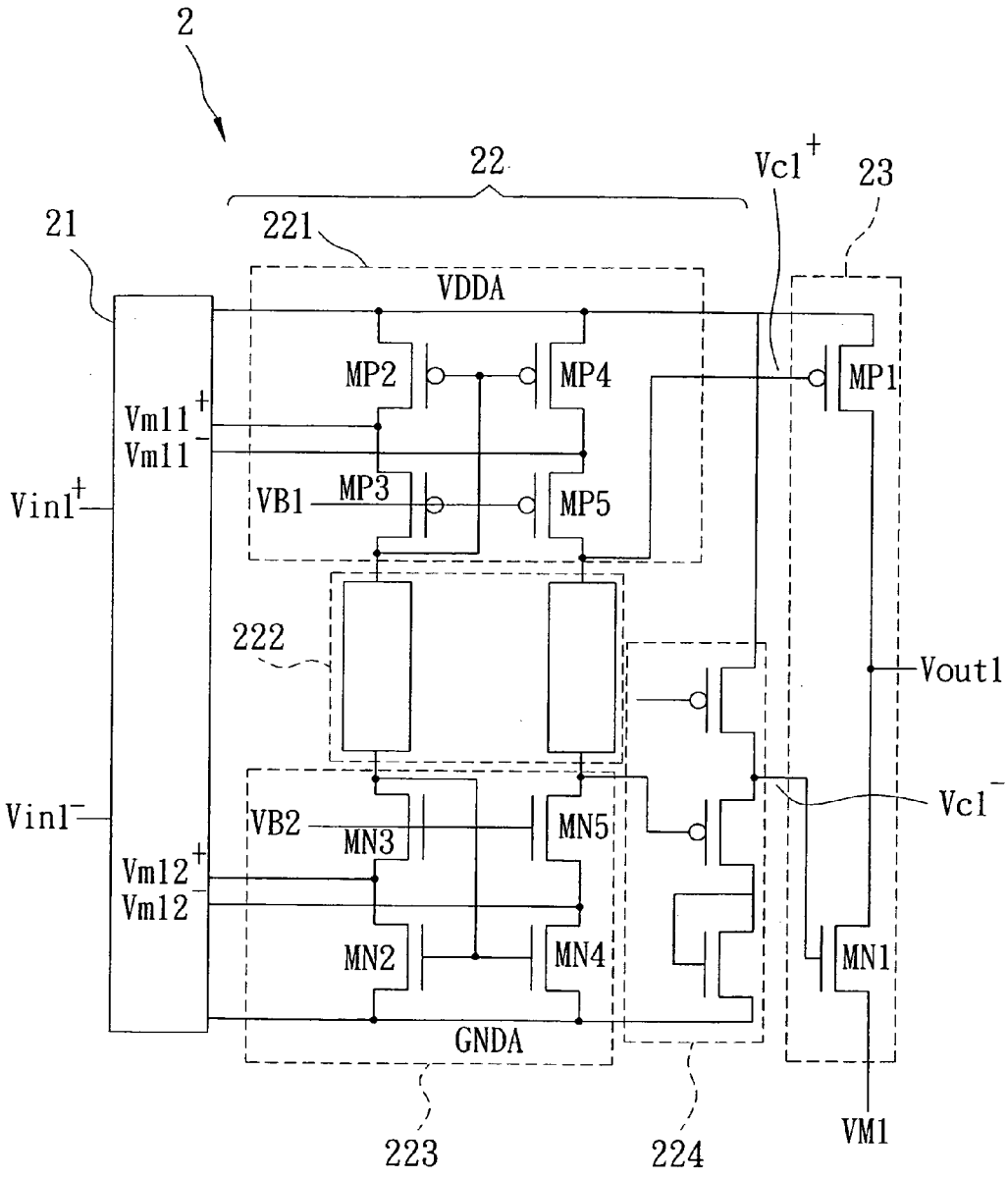
FIG. 12 is a circuit schematic diagram of a first differential driving unit of the third preferred embodiment of the dual voltage output circuit according to the present invention.
Figure 13:
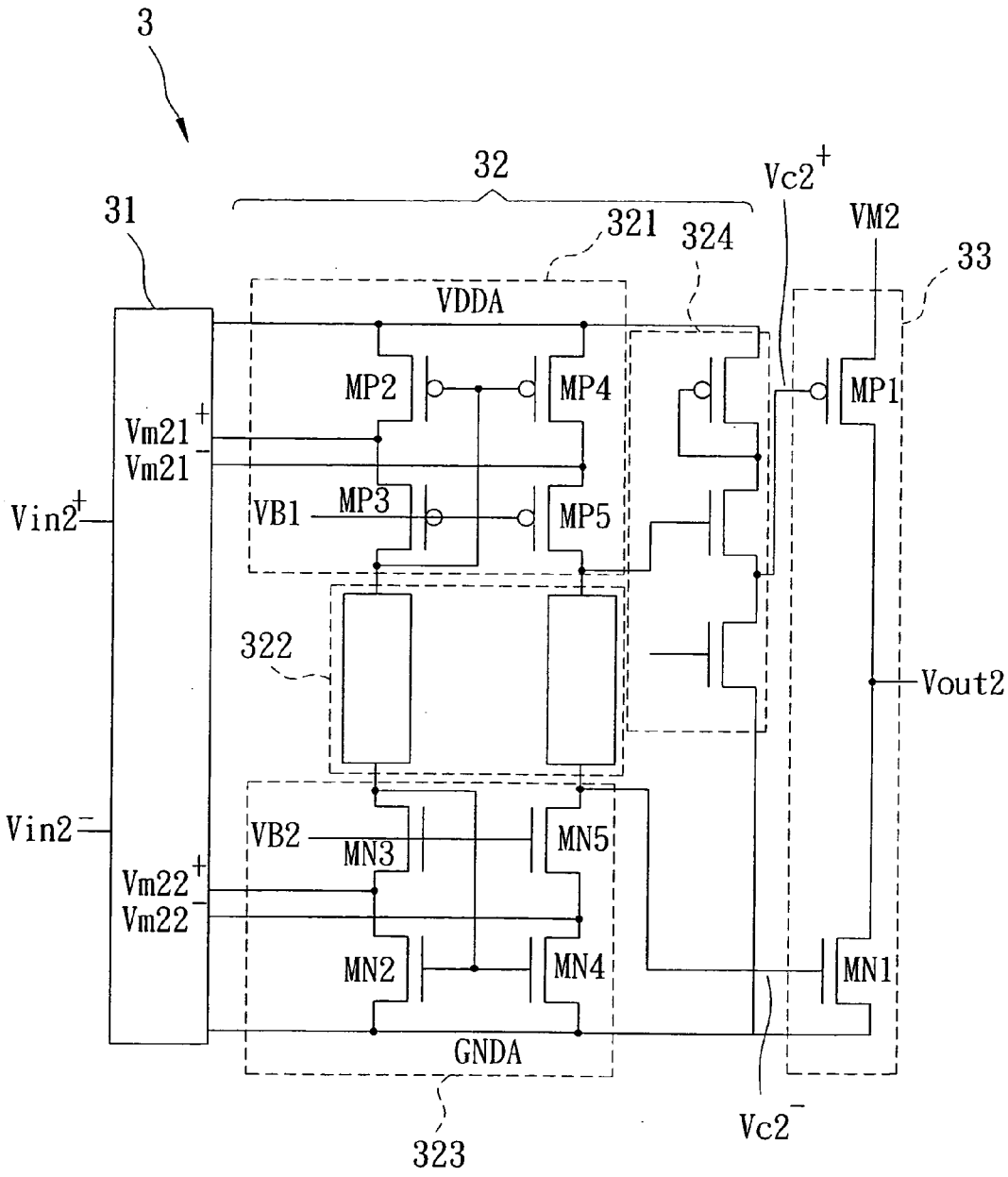
FIG. 13 is a schematic circuit diagram of a second differential driving unit of the third preferred embodiment of the dual voltage output circuit.

Referring to FIGS. 12 and 13, in the third preferred embodiment, which is a modification of the first preferred embodiment, each of the first and second intermediate stages 22, 32 includes a first active load 221,321, an intermediate load 222, 322 coupled to the first active load 221, 321, and a second active load 223, 323 coupled to the intermediate load 222, 322.

The first intermediate stage 22 of the third preferred embodiment further includes a first voltage-level adjusting module 224 that is coupled electrically to the intermediate load 222 and the second active load 223 of the first intermediate stage 22. One of the pair of first control voltages ($Vc1^+$, $Vc1^-$) is outputted at a junction of the first active load 221 and the intermediate load 222 of the first intermediate stage 22. The other one of the pair of first control voltages ($Vc1^+$, $Vc1^-$) is outputted by the first voltage-level adjusting module 224.

The second intermediate stage 32 of the third preferred embodiment further includes a second voltage-level adjusting module 324 that is coupled electrically to the intermediate load 322 and the first active load 321 of the second intermediate stage 32. One of the pair of second control voltages ($Vc2^+$, $Vc2^-$) is outputted at a junction of the second active load 323 and the intermediate load 322 of the second intermediate stage 32. The other one of the pair of second control voltages ($Vc2^+$, $Vc2^-$) is outputted by the second voltage-level adjusting module 324.

In the aforesaid preferred embodiments, when the pairs of first and second input voltages ($Vin1^+$, $Vin1^-$), ($Vin2^+$, $Vin2^-$) change, the first and second output voltage (Vout1), (Vout2) will change accordingly, and the first n-type transistor (MN1) of the first output stage 23 and the first p-type transistor (MP1) of the second output stage 33 will conduct such that a current flows across the first and second terminals thereof. As the current flows between the first and second output stages 23, 33, electric charges of the first and second output stages 23, 33 are redistributed. For example, if the first output voltage (Vout1) increases and the second output voltage (Vout2) decreases, the redundant electric charges of the first output stage 23 are transferred to the second output stage 33. Therefore, current is not drawn from the operational voltage (VDDA) to increase the second output voltage (Vout2), thereby reducing power consumption.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A dual voltage output circuit comprising:

a first differential driving unit including a first input stage adapted for receiving a pair of first input voltages, and operable to generate first and second pairs of first intermediate voltages from the first input voltages, a first intermediate stage directly coupled to said first input stage for receiving the first and second pairs of first intermediate voltages therefrom, and operable to generate a pair of first control voltages from the first and second pairs of first intermediate voltages, said first intermediate stage having a first node to receive a first voltage level, and a second node to receive a second voltage level, and a first output stage directly coupled to said first intermediate stage for receiving the pair of first control voltages therefrom, and operable to generate a first output voltage from the pair of first control voltages, said first output stage being directly coupled to said first node of said first intermediate stage and having a first intermediate voltage node to receive a first intermediate voltage level that is between the first and second voltage levels; and a second differential driving unit including a second input stage adapted for receiving a pair of second input voltages, and operable to generate first and second pairs of second intermediate voltages from the second input voltages, a second intermediate stage directly coupled to said second input stage for receiving the first and second pairs of second intermediate voltages therefrom, and operable to generate a pair of second control voltages from the first and second pairs of second intermediate voltages, said second intermediate stage having a third node to receive the first voltage level, and a fourth node to receive the second voltage level, and a second output stage directly coupled to said second intermediate stage for receiving the pair of second control voltages therefrom, and operable to generate a second output voltage from the pair of second control voltages, said second output stage being directly coupled to said fourth node of said second intermediate stage and having a second intermediate voltage node to receive a second intermediate voltage level that is between the first and second voltage levels;

wherein each of said first and second output stages includes a p-type transistor and an n-type transistor, each of which has a first terminal, a second terminal, and a control terminal, said control terminal of each of said p-type transistor and said n-type transistor of said first output stage is directly coupled to said first intermediate stage for receiving a respective one of the pair of first control voltages, said first terminals of said p-type transistor and said n-type transistor of said first output stage being directly coupled to each other, the first output voltage being outputted at said first terminals of said p-type transistor and said n-type transistor of said first output stage, said second terminal of one of said p-type transistor and said n-type transistor of said first output stage being directly coupled to said first node of said first intermediate stage, said second terminal of the other one of said p-type transistor and said n-type transistor of said first output stage being directly coupled to said first intermediate voltage node, and said control terminal of each of said p-type transistor and said n-type transistor of said second output stage is directly coupled to said second intermediate stage for receiving a respective one of the pair of second control voltages therefrom, said first terminals of said p-type transistor and said n-type transistor of said second output stage being directly coupled to each other, the second output voltage being outputted at said first terminals of said p-type transistor and said n-type transistor of said second output stage, said second terminal of one of said p-type transistor and said n-type transistor of said second output stage being directly coupled to said fourth node of said second intermediate stage, said second terminal of the other one of said p-type transistor and said n-type transistor of said second output stage being directly coupled to said second intermediate voltage node.

2. The dual voltage output circuit as claimed in claim 1, further comprising a bias voltage unit that outputs first, second, third, and fourth bias voltages, wherein each of said first and second intermediate stages includes first and second active loads, and a floating current module, said floating current module of said first intermediate stage being coupled to said bias voltage unit to receive the first and second bias voltages therefrom, and having first and second load connection nodes that are directly coupled and respectively to said first and second active loads of said first intermediate stage, the pair of first control voltages being outputted at said first and second load connection nodes of said floating current module of said first intermediate stage, respectively, said floating current module of said second intermediate stage being coupled to said bias voltage unit to receive the third and fourth bias voltages therefrom, and having third and fourth load connection nodes that are directly coupled and respectively to said first and second active loads of said second intermediate stage, the pair of second control voltages being outputted at said third and fourth load connection nodes of said floating current module of said second intermediate stage, respectively.

3. The dual voltage output circuit as claimed in claim 2, wherein said bias voltage unit includes a bias voltage module, first and second p-type bias-voltage transistors, and first and second n-type bias-voltage transistors, said bias voltage module having a fifth node to receive the first voltage level, and a sixth node to receive the second voltage level, said bias voltage module being operable to generate the first, second, third, and fourth bias voltages, each of said first and second p-type bias-voltage transistors and said first and second n-type bias-voltage transistors including first and second terminals and a control terminal, said second terminal of said second n-type bias-voltage transistor being directly coupled to said first intermediate voltage node of said first output stage, said first terminal and said control terminal of said second n-type bias-voltage transistor being directly coupled to said bias voltage module for receiving the first bias voltage therefrom, and being further directly coupled to said floating current module of said first intermediate stage, said second terminal of said first p-type bias-voltage transistor being directly coupled to said fifth node of said bias voltage module, said first terminal and said control terminal of said first p-type bias-voltage transistor being directly coupled to said bias voltage module for receiving the second bias voltage therefrom, and being further directly coupled to said floating current module of said first intermediate stage, said second terminal of said first n-type bias-voltage transistor being directly coupled to said sixth node of said bias voltage module, said first terminal and said control terminal of said second n-type bias-voltage transistor being directly coupled to said bias voltage module for receiving the third bias voltage therefrom, and being further directly coupled to said floating current module of said second intermediate stage, said second terminal of said second p-type bias-voltage transistor being directly coupled to said second intermediate voltage node of said second output stage, said first terminal and said control terminal of said second p-type bias-voltage transistor being directly coupled to said bias voltage module for receiving the fourth bias voltage therefrom, and being further directly coupled to said floating current module of said second intermediate stage.

4. The dual voltage output circuit as claimed in claim 1, wherein the first and second intermediate voltage levels are the same voltage level.

5. The dual voltage output circuit as claimed in claim 1, wherein the first and second intermediate voltage levels are different voltage levels.

6. The dual voltage output circuit as claimed in claim 1, wherein said first input stage is directly coupled to said first node of said first intermediate stage so as to receive the first voltage level, and to said first intermediate voltage node of said first output stage so as to receive the first intermediate voltage level, and is operable to generate the first and second pairs of first intermediate voltages from the first input voltages based upon the first voltage level and the first intermediate voltage level, and said second input stage is directly coupled to said fourth node of said second intermediate stage so as to receive the second voltage level, and to said second intermediate voltage node of said second output stage so as to receive the second intermediate voltage level, and is operable to generate the first and second pairs of second intermediate voltages from the second input voltages based upon the second voltage level and the second intermediate voltage level.

7. The dual voltage output circuit as claimed in claim 1, wherein:

each of said first and second intermediate stages includes a first active load, an intermediate load coupled to said first active load, and a second active load coupled to said intermediate load;

said first intermediate stage further including a first voltage-level adjusting module that is directly coupled to said intermediate load and said second active load of said first intermediate stage;

one of the first control voltages being outputted at a junction of said first active load and said intermediate load of said first intermediate stage, the other one of the first control voltages being outputted by said first voltage-level adjusting module;

said second intermediate stage further including a second voltage-level adjusting module that is directly coupled to said intermediate load and said first active load of said second intermediate stage;

one of the second control voltages being outputted at a junction of said second active load and said intermediate load of said second intermediate stage, the other one of the second control voltages being outputted by said second voltage-level adjusting module.

8. A dual voltage output circuit as claimed in claim 1, which is for application to a pixel circuit controller that is configured for driving operations of pixel circuits of a liquid crystal display module.

* * * * *